United States Patent [19]

Bienvenu et al.

[11] Patent Number: 4,820,339

[45] Date of Patent: Apr. 11, 1989

[54] PRODUCTION OF METAL POWDERS BY REDUCTION OF METAL SALTS IN FUSED BATH

[75] Inventors: Gérard-Pierre Bienvenu, Sevraz; Bernard Chaleat, Norcier; Dominique Dubruque, Bonne; Jean-Claude Girardot; Philippe Vaxelaire, both of Ville La Grand, all of France

[73] Assignee: Cerex, Annemasse, France

[21] Appl. No.: 59,700

[22] Filed: Jun. 9, 1987

[51] Int. Cl.[4] ..... C22B 27/00

[52] U.S. Cl. ..... 75/0.5 BB; 75/0.5 B; 75/84.4; 75/84.5; 75/251

[58] Field of Search ..... 75/0.5 BB, 251, 0.5 B, 75/84.5, 84.4

[56] References Cited

U.S. PATENT DOCUMENTS

| | | | |
|---|---|---|---|
| 2,839,386 | 6/1958 | Davies | 75/84.5 |
| 3,829,310 | 8/1974 | Mahy | 75/0.5 BB |
| 3,992,192 | 11/1976 | Vartanian | 75/0.5 BB |
| 4,105,440 | 8/1978 | Gentaz et al. | 75/84.5 |
| 4,149,876 | 4/1979 | Rerat | 75/0.5 BB |
| 4,379,128 | 4/1983 | Hähn et al. | 75/0.5 BB |
| 4,419,125 | 12/1983 | Charles et al. | 75/0.5 BB |
| 4,582,530 | 4/1986 | Heinrich et al. | 75/0.5 BB |

*Primary Examiner*—Upendra Roy
*Attorney, Agent, or Firm*—Millen & White

[57] ABSTRACT

In a process for the production of a metal by reducing a salt of said metal, an exchange is carried out between a reducing metal and a reducible metal within a fused salt bath under conditions in which the reducible metal in the reduced metal state is immiscible in the bath in the presence of the reducing metal which has previously been dissolved in the bath.

18 Claims, 1 Drawing Sheet

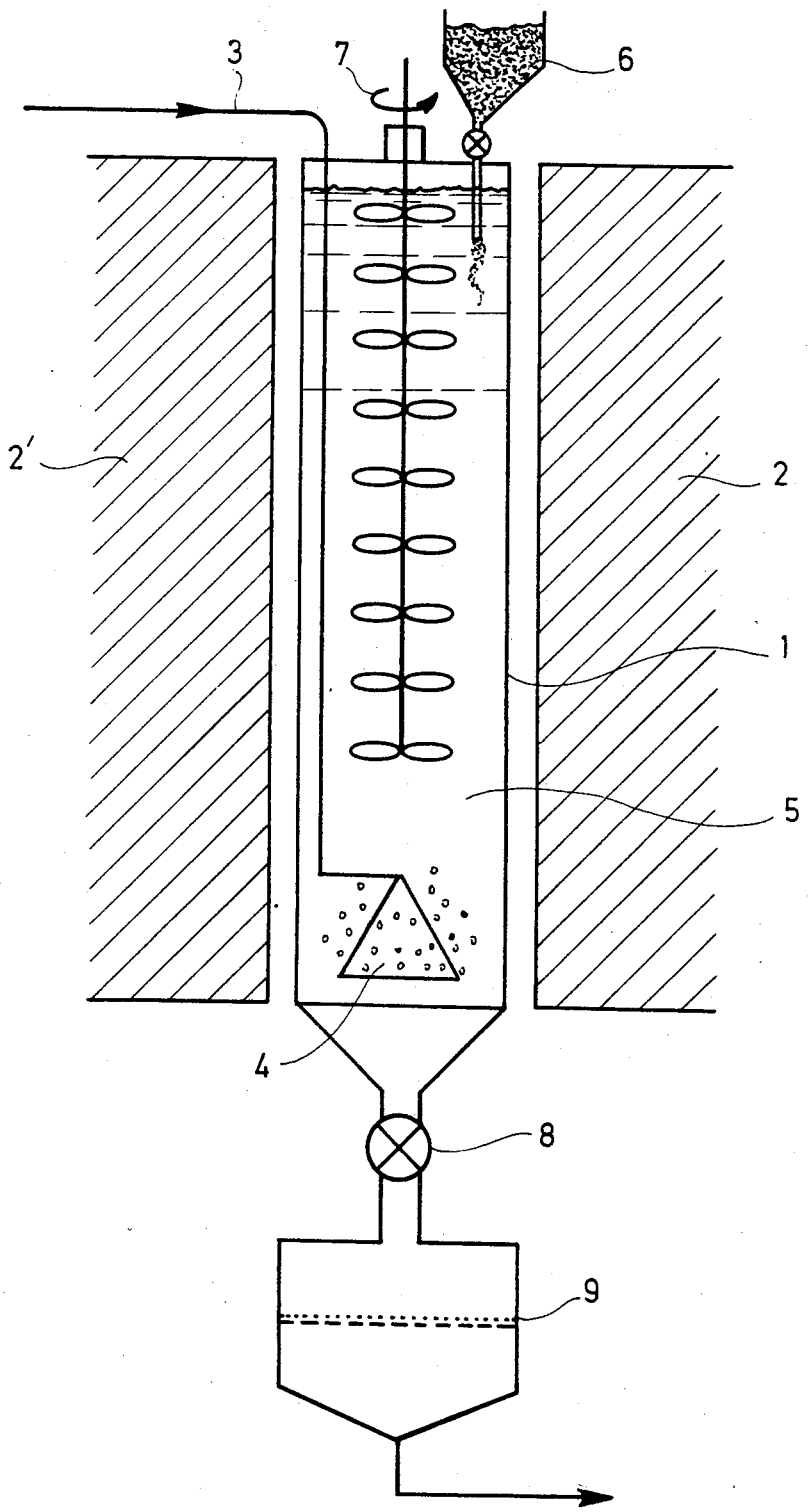
3
7
6
2'
2
1
5
4
8
9

PRODUCTION OF METAL POWDERS BY REDUCTION OF METAL SALTS IN FUSED BATH

BACKGROUND OF THE INVENTION

The present invention relates to the preparation of metals by reduction of their salts in a process involving a chemical exchange reaction with a reducing metal for the reducible metal to be produced, in a reaction medium which ensures contact between the metals and the corresponding salts. While this process makes it possible to obtain reduced metals in either the liquid or solid state and readily separable from the reaction medium, the industrial application for which the invention is of primary interest is the production of refractory metals in the form of powder.

Among the refractory metals of the type considered, one example worthy of mention is titanium.

At the present time, the processes in most common use for the production of titanium are the Kroll process and the Hunter process which involve the use of a reducing agent consisting of magnesium or sodium metal respectively, this reducing agent being reacted with titanium chloride vapors at high temperature and in a neutral atmosphere.

These processes lead to the production of titanium in a porous form often known for this reason as titanium sponge. As a rule, however, titanium sponges cannot be used directly in this form but require subsequent purification treatments which are highly power-consuming. And if these sponges are converted to ingots, machining of ingots unfortunately results in substantial losses of material which may vary between 30% and 90% by weight, depending on the shape of the final products.

However, U.S. Pat. No. 2,839, 385 has proposed a method of reduction of titanium by magnesium in a magnesium chloride bath. But the reaction starts in this case from the dichloride $TiCl_2$ which has to be prepared beforehand by reduction of the tetrachloride with titanium metal. Control of the intermediate production of the dichloride makes this process inconvenient and ill-adapted for use on an industrial scale.

The present invention provides a solution to these difficulties by means of a process for the production of titanium powder which can be utilized directly in powder metallurgy techniques. The advantage of this process, while particularly apparent in the case of titanium, also applies to other metals and especially tantalum which is employed in powdered form for the fabrication of capacitors as well as to niobium. Furthermore, the same process is potentially useful for producing other metals obtained in the liquid state such as magnesium.

SUMMARY OF THE INVENTION

The invention proposes a process for the production of a metal by reduction of a salt of said metal, in which an exchange is carried out between a reducing metal and a reducible metal within a bath of molten metal halides under conditions in which the reducible metal in the reduced metal state is immiscible in the bath in the presence of the reducing metal which has previously been dissolved in said bath.

It must be understood that each metal which takes part in the reaction can be either a pure metal or a mixture of metals or an alloy. Similarly, the corresponding metal salts can be mixtures of salts. It may in particular be found advantageous to carry out the reaction on mixtures of fused salts which form between themselves eutetic compounds having a lower melting point than the individual salts. This applies either to the reducible metal or preferably to the reducing metal or else again to each one of them. In consequence, all the salts employed in the process are usually halides.

In the practical execution of the process, it is an advantage to choose calcium as a reducing metal and, in a first step, to dissolve the calcium entirely in the bath of fused salts constituting the reaction medium. This condition makes it possible in a second step to start with a wide variety of products to be reduced in the state of finely divided solids, liquids or gases which will in that case not necessarily be dissolved but only dispersed in the bath. However, preferential conditions for execution of the process involve dissolution of the reducing metal, usually by converting this metal to a soluble compound in the bath, whilst the metal to be produced is initially in the form of a compound which is also soluble and is obtained in the state of an insoluble reduced metal and more particularly a solid powder.

In accordance with a secondary feature of the method contemplated by the invention, the reducing metal is produced in the same bath from its salt and from a metal compound of higher reducing power consisting of calcium carbide $CaC_2$. This preliminary reduction step produces the reducing metal in situ in the bath, which has proved to be highly favorable to the production of a final powder of good quality. Carbon can readily be collected in the solid state and separated from the bath prior to introduction of the metal to be reduced, usually in the form of halide.

This procedure makes it possible to regenerate the reaction bath by producing the reducing metal in situ and is accordingly applicable not only to calcium or sodium but above all to magnesium. The effectiveness of magnesium can accordingly be ensured in the method of the invention in spite of its low solubility.

The value adopted for the temperature of the bath is naturally equal to or higher than the melting point of its essential constituents and especialy the melting point of calcium chloride or its eutectic compounds which can thus constitute the aforementioned fused salt for dissolving the reducing calcium. For example, in a vertical reactor, the calcium can be introduced into the top of the reactor in the state of a finely divided solid having a particle size of the order of 0.5 to 2 millimeters, for example. A point worthy of note is that calcium can also be produced in situ in the bath from calcium carbide, in particular by exchange with magnesium which is present in the state of chloride dissolved in the bath. In the event that the reduced metal is obtained in the solid state, the temperature of the bath usually modifies the particle size of the metal which is formed since a higher temperature results in metal particles of larger size and conversely.

In regard to the halide of the metal to be reduced, it can be introduced into the reactor, for example into the base of a vertical reactor, in the state of a halide in the liquid phase or in the gas phase. If the halide is in the liquid phase, the temperature of the fused salt bath which is usually of a high order (higher than 500° C. in the majority of instances), is capable of causing vaporization of the halide which may prove sufficient to result in its dispersion and even dissolution in the bath. In order to meet with similar conditions, it is also possible to proceed directly to an injection of halide into the fused salt in the form of gas.

The injections on the one hand of metal halide to be reduced and on the other hand of the reducing metal can be carried out simultaneously on condition, however, that the distance between the injection points is such that the halide to be reduced and the reducing metal respectively are dissolved in the salt before they are able to react with each other.

The reduced metal to be produced can be selected in particular from those of the group consisting of : Al, Si, Cr, Co, Fe, Ni, Ti, Zr, V, Nb, Ta, Mo and W.

For reasons which will be explained hereinafter, the present invention is not limited but nevertheless particularly well-suited to the so-called refractory metals or in other words metals having extremely high melting points and obtained in the state of powdered solids. Particularly worthy of mention among these metals are titanium, niobium and tantalum.

In the most frequent case, the halide of these metals which is employed within the scope of the method in accordance with the invention is a chloride.

In regard to the reducing metal, it is possible to employ not only calcium but also and in particular lithium (Li), sodium (Na), potassium (K), beryllium (Be) or strontium (Sr) or in certain cases the mixture Mg/Ca which has made it possible to obtain particularly favorable results in the case of titanium production. In this case, the fused salt bath is advantageously constituted by a mixture $MgCl_2/CaCl_2$.

Among the eutectic compounds which may be used as suitable constituents of the reaction medium, mention may accordingly be made of the mixtures $MgCl_2/CaCl_2$ but also the mixtures $MgCl_2/NaCl$ and $CaCl_2/NaCl$ which, in suitable proportions, form eutectic compounds having a relatively low melting point.

A further advantage of the invention lies in the possibility of forming alloys in the process of production of reduced metal. To this end, it is simply necessary to inject, not a metal halide $MeX_n$ but a mixture of several halides of different metals. By making a suitable choice of halides and more especially the chlorides of the metals concerned and by introducing them in predetermined proportions, it is possible to produce alloys having a composition which will reflect the proportions of the metals introduced. When the direct production of alloys in powdered form does not appear to be feasible, it is nevertheless possible to form the alloy subsequently by sintering from the metallic mixture in accordance with conventional techniques of powder metallurgy.

BRIEF DESCRIPTION OF THE DRAWING

For the purpose of explanatory illustration, the invention will now be described with reference to the accompanying drawing which represents one embodiment of a device for the practical application of the method in accordance with the invention.

DESCRIPTION OF THE PREFERRED EMBODIMENT

The device in accordance with the invention includes a reactor 1 which is of considerable height in comparison with the width for reasons which will be explained below. Heating means 2, 2' of a type known per se are placed around the reactor 1 in order to attain and maintain the requisite temperature within this latter.

The metal halide to be produced such as $TiCl_4$, for example, is introduced through a tube 3 which opens into the bottom of the reactor 1 within a diffuser 4 which serves to disperse the metal halide within the liquid contained in the reactor 1.

Said liquid 5 consists of a mixture of molten metal halides in which the oxidation-reduction exchange takes place between the metal to be reduced and the reducing metal.

Assuming that the reducing metal consists of calcium in the solid state, this metal is introduced into the reactor 1 at 6, namely in the portion which is most distant from the diffuser 4. In the case of the figure, the diffuser 4 is located at the bottom of the reactor whilst the hopper for the supply of reducing metal 6 is located at the top of said reactor.

The process carried out in the melting bath 5 involves on the one hand dissolution of the reducing metal in its halide within said bath and on the other hand dispersion or dissolution of the halide to be reduced.

In order to carry out this dispersion in the reaction medium, stirring means 7 are provided within the reactor 1.

In the upper portion of the reactor 1, the metal or metals introduced at 6 are first impelled mechanically and then dissolved. They migrate by diffusion or by convection within the reaction medium. In the homogeneous solution of calcium in fused salt which is thus obtained, there is then carried out a reduction of the halides introduced into the bottom of the reactor. The reaction produces a powder which readily settles as is the case with titanium, for example.

There are various ways of recovering this powder after the reactor 1 has first been drained by means of a thermal valve 8 equipped with heating means for liquefying the solidified metal salts. In particular, it is possible to direct the bath fraction concerned to a filter 9 from which is collected a "cake" which can be retreated after crushing with alcohol, with water or else with acidulated water in order to extract the powdered metal therefrom. It is also possible to separate the metal from its salt by distillation of this latter.

In the physical state in which it is thus produced, the metal can be readily worked by means known per se, taking into account its high degree of purity. It can be employed in particular in powder metallurgy in accordance with techniques which are straightforward in contrast to the sponges which were difficult to crush and were obtained by techniques previously applied to metals such as titanium.

In order to regenerate the salt bath, this latter can be put in contact with a compound having higher reducing power such as calcium carbide, for example. Assuming that regeneration takes place in a separate reactor rather than directly in the halide bath, it is possible to make arrangements such that the residual salt containing the carbon and the carbide impurities is retreated by blowing air in order to purify the salt and generate heat.

The examples which now follow are given by way of additional explanatory illustration of the method in accordance with the invention.

EXAMPLE 1

In this example, the metal halide to be reduced was titanium tetrachloride $TiCl_4$ and the reducing metal was calcium.

The reactor employed was of cylindrical shape and had a diameter of 8 cm. A quantity of 3 kg of $CaCl_2$ was poured into this reactor and the fused salt bath had a depth of the order of 30 cm. The operation was performed at the temperature of the fused calcium chloride, namely 830° C.

Calcium was first passed to the top of the reactor after starting agitation of the bath. The calcium was injected in the form of beads having a mean diameter of the order of 1 mm. These beads were readily dissolved in the bath of fused $CaCl_2$.

Titanium tetrachloride in the liquid state was then fed by means of an injector to the bottom of a tubular reactor which was placed vertically. The titanium tetrachloride was volatilized and the gas bubbles escaped at the base of the injector and were finely dispersed by agitation.

In order to guard against corrosion of the reactor walls, a small excess quantity of calcium was provided with respect to the stoichiometric proportions corresponding to the reaction involving reduction of $TiCl_4$ by Ca.

On completion of the reaction, agitation was allowed to continue over a period of approximately 15 minutes and was then stopped so as to allow the titanium powder to settle. This settling process lasted approximately 10 minutes.

The lower half of the bath was then withdrawn by means of a thermal valve and this half was passed through a filter of a type known per se.

The titanium powder thus obtained was subjected to chemical analysis which produced the results given below. As is the case throughout this specification, all percentages are expressed by weight.

Ti:99.80%
O:0.05% (500 ppm)
Fe:0.05% (500 ppm)
Ni:0.004% (40 ppm)
Cr:0.007% (70 ppm)
N:0.005% (50 ppm)
H:0.015% (150 ppm)
S:0.025% (250 ppm)

The particle diameter of the titanium powder was within the range of 1 to 10 microns.

In the case of an injected quantity of 1.08 kg of Ca and 2.55 kg of $TiCl_4$, there were recovered between 600 and 640 g of titanium powder, which corresponded to a yield within the range of 92.5% to 99%.

EXAMPLE 2

In order to reduce the temperature of the reaction medium and consequently the power consumption, the operation was performed in a eutectic mixture $CaCl_2$-/NaCl having a melting point of the order of 500° C. in the case of a weight composition corresponding to approximately 34.5% by weight of NaCl.

In order to maintain the eutectic composition, arrangements were made for simultaneous addition of powdered sodium chloride at the same time as calcium in a proportion of 146.3 g of NaCl in respect of 100 g of Ca.

The other operating conditions were identical with those of Example 1.

In the reactor which contained at the outset 3 kg of eutectic mixture $CaCl_2$/NaCl, there were added 0.5 kg of Ca, 0.73 kg of NaCl, then 1.18 kg of $TiCl_4$ at a temperature of approximately 580° C.

After settling and filtration, there were recovered 292 g of titanium in powdered form and having a particle diameter within the range of 0.3 to 5 microns, which corresponded to a yield of the order of 97% by weight.

After analysis, the purity of the titanium powder was of the order of 99.85%.

The proportions of detected impurities were appreciably lower than in the previous example, namely as follows:

Fe: 300 ppm
O: 250 ppm
H: 100 ppm

EXAMPLE 3

As in the case of titanium, it is possible to produce tantalum from the pentachloride $TaCl_5$ which melts at 220° C. and boils at 234° C.

Into 2 kg of a salt bath formed by the eutectic mixture $CaCl_2$/NaCl containing approximately 34.5% by weight of NaCl, calcium metal in the form of beads 0.5 to 1 mm in diameter was injected into the top of the reaction vessel at the same time as the sodium chloride. The vapor of $TaCl_5$ was then introduced into the bottom of the reactor, the tantalum pentachloride having previously been brought to the boil within a separate cell.

There were then injected 1692 g of $TaCl_5$, 472 g of Ca and 690 g of NaCl.

The level of the bath had practically doubled within the cell and, after filtration of the fused salt bath and washing with water and alcohol, there were finally collected 830 g of powder having a particle diameter within the range of 0.5 to 3 microns.

The operating temperature was 600° C. The measured yield was 97%.

EXAMPLE 4

In order to obtain tantalum particles of greater volume than in the preceding example, the operation was performed at a higher temperature (850° C.) in 2 kg of bath consisting of pure $CaCl_2$. There were then added 505 g of calcium and 1800 g of $TaCl_5$.

There were finally collected 898 g of tantalum in the powdered state and having a particle diameter within the range of 5 to 10 microns.

The yield was practically equal to unity (approximately 99%).

EXAMPLE 5

The same procedures as in Example 4 was again adopted but with $NbCl_5$ preheated to 370° C. within an ancillary cell for injecting this compound in the form of vapor. There were accordingly injected 400 g of Ca and 1080 g of $NbCl_5$.

There were finally obtained 370 g of niobium powder having a particle diameter of 1 to 6 microns, namely a yield practically equal to unity.

EXAMPLE 6

Zirconium powder was produced under conditions identical with those prevailing for the production of titanium, namely as follows:

salt bath consisting of pure $CaCl_2$ (3 kg) at 850° C.;
$ZrCl_4$ heated to a temperature above its sublimation point within an ancillary cell (350° C.).

The injection of 400 g of Ca and 1166 g of $ZrCl_4$ permitted the recovery of 446 g of zirconium powder having a particle size within the range of 0.3 to 10 microns, namely a yield of 98%.

EXAMPLE 7

The method employed for the preparation of titanium in powdered form in accordance with Examples 1 and 2 was applied under conditions similar to the production of magnesium metal by reduction of the chloride $MgCl_2$.

In this case, the metal produced is in the liquid state at the temperature of the fused salt bath. However, although the chlorides and the reducing metal (Ca or Ca and Na) dissolve in this bath at the concentrations employed, liquid magnesium is sparingly soluble in the bath. In consequence, it settles at the top surface and can readily be collected in the practically pure state.

EXAMPLE 8

To a salt bath having a base of calcium chloride $CaCl_2$, there was added magnesium chloride $MgCl_2$ and then calcium carbide $C_2Ca$ in small fragments. Only a small quantity of sodium chloride is employed in this case since the calcium carbide already has low solubility in the magnesium chloride.

The reaction is performed at 800° C. There are thus obtained magnesium in the liquid state, carbon in the solid state and basic salt ($CaCl_2$). Separation of the carbon makes it possible to obtain a reducing bath having a base of magnesium produced in situ in the fused salt bath.

Titanium tetrachloride was added in a reactor containing a calcium chloride bath with an addition of magnesium. The reaction then took place in accordance with the procedure of Example 1.

This reaction led to the formation of titanium metal and magnesium chloride. The titanium was then separated from the salt mixture $Cl_2Mg/Cl_2Ca$.

This mixture of metal salts was regenerated by reduction with calcium carbide in accordance with the procedure outlined in the foregoing and separation of the carbon by filtration or calcination so as to be subsequently reused in the preceding reactor for carrying out reduction of the titanium by magnesium.

The same procedure of regeneration of the bath by calcium carbide can be applied when the reducing metal is calcium.

It will be readily apparent that the invention cannot be considered as limited to the specific modes of execution which have been described in the foregoing examples. It will in fact be possible for those versed in the art to adapt operating conditions to the particular problem which is presented.

What is claimed is:

1. A process for the production of a metal by reduction of a salt of said metal, said process comprising providing a reducing metal dissolved in a bath of fused metal salts and adding the salt to be reduced under conditions in which the reducible metal in the state of reduced metal is immiscible in the bath in the presence of the reducing metal in the state of salt dissolved in said bath, said reducing metal being introduced into said bath in the state of a mixture with a halide of another metal forming with the halide of said reducing metal a eutectic mixture which constitutes said bath.

2. A process according to claim 1, wherein the reduction is carried out by calcium dissolved in said bath.

3. A process according to claim 1, wherein the reducing metal is magnesium which is formed in situ in the fused salt bath by reduction of a magnesium halide in solution by calcium carbide and wherein the carbon formed prior to injection of the salt of the metal to be reduced is removed.

4. A process according to claim 1, wherein the reducing metal is regenerated by action of the calcium carbide on the halide of said reducing metal.

5. A process according to claim 2, wherein the reduction is carried out by means of said metal salt in the dissolved state in said bath.

6. A process according to claim 2, wherein the salt to be reduced is a titanium halide, a tantalum halide or a niobium halide and wherein the reduced metal is obtained in the powdered state.

7. A process according to claim 2, wherein the reducing calcium is introduced into said bath in the divided state with agitation.

8. A process according to claim 3, wherein said salt to be reduced is titanium tetrachloride.

9. A process according to claim 5, wherein said metal salt to be reduced is a chloride.

10. A process for the production of a reducible metal (A) by reduction of a salt of said metal, said process comprising forming a reducing metal (B) in a fused salt bath by reduction of a salt of said reducing metal with calcium carbide, reacting resultant reducing metal (B) with said salt of said reducible metal (A) in said fused salt bath under conditions in which the reducible metal in the state of reduced metal is immiscible in the bath in the presence of the reducing metal in the state of salt dissolved in said bath.

11. A process according to claim 10, wherein carbon formed by the reaction of calcium carbide is removed from the fused salt bath prior to adding said salt of said reducible metal (A) to said salt bath.

12. A process according to claim 10, wherein said salt of said reducing metal is a magnesium halide.

13. A process according to claim 12, wherein said salt to be reduced is titanium tetrachloride.

14. A process for the production of a metal by reduction of a salt of said metal, said process comprising providing a reducing metal dissolved in a bath of fused metal salts, adding the salt to be reduced under conditions in which the reducible metal in the state of reduced metal is immiscible in the bath in the presence of the reducing metal in the state of salt dissolved in said bath, and reacting resultant salt of said reducing metal with calcium carbide so as to regenerate said reducing metal.

15. A process according to claim 14 wherein said salt of said reducing metal is a halide.

16. A process according to claim 15, wherein the salt to be reduced is a titanium halide, a tantalum halide or a niobium halide and wherein the reduced metal is obtained in the powdered state.

17. A process according to claim 16, wherein the reducing metal is a magnesium halide.

18. A process according to claim 17 wherein the salt to be reduced is titanium tetrachloride.

* * * * *